US011741865B2

(12) United States Patent
Jang et al.

(10) Patent No.: US 11,741,865 B2
(45) Date of Patent: Aug. 29, 2023

(54) APPARATUS FOR TESTING DISPLAY DEVICE AND DISPLAY DEVICE FOR PERFORMING MURA COMPENSATION AND MURA COMPENSATION METHOD

(71) Applicant: Samsung Display Co., Ltd., Yongin-Si (KR)

(72) Inventors: Sihun Jang, Hwaseong-si (KR); Seyun Kim, Hwaseong-si (KR); Sangcheol Park, Hwaseong-si (KR); Mingyu Kim, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 135 days.

(21) Appl. No.: 17/191,600

(22) Filed: Mar. 3, 2021

(65) Prior Publication Data

US 2021/0398462 A1 Dec. 23, 2021

(30) Foreign Application Priority Data

Jun. 22, 2020 (KR) ..... 10-2020-0076019

(51) Int. Cl.
*G09G 3/00* (2006.01)
*G09G 3/34* (2006.01)

(52) U.S. Cl.
CPC ..... *G09G 3/006* (2013.01); *G09G 2310/0267* (2013.01); *G09G 2310/0275* (2013.01); *G09G 2320/0233* (2013.01); *G09G 2340/04* (2013.01)

(58) Field of Classification Search
CPC ..... G02F 1/1333; G02F 1/1368; G09G 5/00; G09G 5/06; G09G 5/10; G09G 5/12; G09G 5/36; G09G 3/00; G09G 3/006; G09G 3/16; G09G 3/20; G09G 3/34; G09G 3/36; G09G 3/3233; G09G 3/3275; G09G 3/3225; G09G 3/3266; G09G 3/3258; G09G 2310/0267; G09G 2310/0275; G09G 2320/0233; G09G 2340/04; G06T 1/20; G06T 5/00;
(Continued)

(56) References Cited

U.S. PATENT DOCUMENTS 9,464,962 B2 10/2016 Kim et al.
9,880,109 B2 1/2018 Kim et al.
(Continued)

FOREIGN PATENT DOCUMENTS

KR 10-1296655 B1 8/2013
KR 10-2014-0121068 A 10/2014
(Continued)

*Primary Examiner* — Chanh D Nguyen
*Assistant Examiner* — Nguyen H Truong
(74) *Attorney, Agent, or Firm* — Innovation Counsel LLP

(57) ABSTRACT

A test apparatus includes a mura detection filter for detecting a mura area based on a detected image signal and outputting position information of the mura area and a filtered image signal, an image enhancement processor for performing deblurring on the filtered image signal based on the position information and outputting a deblurred image signal, a mura corrector for generating first compensation data for the mura area based on the deblurred image signal, a sampling corrector for generating second compensation data for a non-mura area based on the detected image signal, and a compensator for outputting compensation data based on the first compensation data and the second compensation data.

18 Claims, 16 Drawing Sheets

(58) Field of Classification Search
CPC .... G06T 5/20; G06T 5/40; G06T 5/50; G06T 7/00; G06T 7/10; G06T 7/11; G06T 7/40; G06T 7/62; G06T 7/136; G06T 15/50; G06T 3/01; G06T 3/03; G06T 3/14; G06T 3/40; H04N 5/57; H04N 7/18; H04N 17/00; H04N 17/02; H04N 17/04; G06K 9/00; G06K 9/46; G06F 1/00; G06F 3/14
See application file for complete search history.

(56) References Cited

U.S. PATENT DOCUMENTS

2008/0309602 A1 12/2008 Hwang
2015/0206276 A1* 7/2015 Jung ..... G06T 3/4007 345/561
2017/0193928 A1* 7/2017 Deng ..... G09G 3/20
2017/0243562 A1* 8/2017 Hu ..... G09G 5/10
2018/0166030 A1* 6/2018 Liu ..... G09G 3/3696
2018/0191371 A1* 7/2018 Tao ..... H03M 7/3062
2018/0233096 A1* 8/2018 Zhao ..... G09G 3/3648
2020/0013326 A1* 1/2020 Zheng ..... G09G 3/20
2020/0118519 A1* 4/2020 Fruchter ..... G09G 5/377
2020/0211442 A1* 7/2020 Kim ..... G09G 3/006
2021/0182587 A1* 6/2021 Akiyama ..... G06V 30/168
2021/0287626 A1* 9/2021 Liu ..... G09G 3/36

FOREIGN PATENT DOCUMENTS

KR 10-2015-0077977 A 7/2015
KR 10-2015-0078838 A 7/2015
KR 10-2016-0006852 A 1/2016
KR 10-1608843 B1 4/2016
KR 10-2017-0066772 A 6/2017

* cited by examiner

APPARATUS FOR TESTING DISPLAY DEVICE AND DISPLAY DEVICE FOR PERFORMING MURA COMPENSATION AND MURA COMPENSATION METHOD

CROSS-REFERENCE TO RELATED APPLICATION

This U.S. non-provisional patent application claims priority under 35 U.S.C. § 119 of Korean Patent Application No. 10-2020-0076019, filed on Jun. 22, 2020, the disclosure of which is hereby incorporated by reference in its entirety.

BACKGROUND

The present disclosure herein relates to a display device and a test apparatus for testing a display device.

Multimedia electronic devices such as a television, a mobile phone, a tablet computer, a navigation device, and a game machine have a display device, and the display device includes a plurality of pixels displaying an image. The pixels that are formed in the same manufacturing process may impart different optical characteristics due to a deviation of the manufacturing process. As a result, the pixels that are provided with an image data signal of the same gradation may output light having different luminance levels due to the deviation of their optical characteristics.

SUMMARY

The present disclosure provides a test apparatus for detecting a deviation of a characteristic of pixels and a display device capable of performing mura compensation.

According to an embodiment of the inventive concept, a test apparatus includes: a mura detection filter configured to detect a mura area based on a detected image signal, and output position information of the mura area and a filtered image signal; an image enhancement processor configured to perform deblurring on the filtered image signal based on the position information, and output a deblurred image signal; a mura corrector configured to generate first compensation data for the mura area based on the deblurred image signal; a sampling corrector configured to generate second compensation data for a non-mura area based on the detected image signal; and a compensator configured to output compensation data based on the first compensation data and the second compensation data.

In an embodiment, the mura detection filter may detect the mura area by performing an erosion operation and a dilation operation on the detected image signal.

In an embodiment, the mura detection filter may perform the erosion operation and the dilation operation based on a variable filter size and a filter shape.

In an embodiment, the mura detection filter may group a plurality of pixels corresponding to the detected image signal into a plurality of areas; calculate a score for each of the plurality of areas based on a portion of the filtered image signal corresponding to each of the plurality of areas; and set an area that has a highest score among scores of the plurality of areas as the mura area.

In an embodiment, the mura detection filter may calculate the filtered image signal by an erosion operation and a dilation operation on the detected image signal; calculate a difference value between the detected image signal and the filtered image signal; calculate a score for each of the plurality of areas based on a deviation between the difference value corresponding to each of the plurality of areas and a reference value; and set an area that has a highest score among the scores of the plurality of areas as the mura area.

In an embodiment, the reference value may include a first reference value and a second reference value, the first reference value may be m+kσ, the second reference value may be m−kσ, m may be average luminance of the filtered image signal, k may be a detection coefficient, and σ may be a standard deviation.

In an embodiment, the image enhancement processor may perform the deblurring on the filtered image signal in an area corresponding to the position information among the plurality of areas.

In an embodiment, the image enhancement processor may perform the deblurring on the filtered image signal using equation $$I^{t(f(f(x,y))}=-\mathrm{sign}(\Delta I^{t-1}f(x,y))|\nabla I^{t-2}(f(x,y))|f(x,y),t\geq 0, \text{ and}$$

Here, f(x,y) may be the filtered image signal, $I^{t(f(x,y))}$ may be a t-th deblurred image signal, and $I^{t-1(f(x,y))}$ may be a (t−1)-th deblurred image signal.

In an embodiment, the image enhancement processor may iteratively calculate the equation until a difference ratio between the t-th deblurred image signal and the (t−1)-th deblurred image signal is equal to or less than a predetermined value.

In an embodiment, the mura corrector may group a plurality of pixels corresponding to the detected image signal into a plurality of compensation blocks; and generate the first compensation data corresponding to a first compensation block that corresponds to the mura area among the plurality of compensation blocks, wherein the first compensation block includes to a×b number of pixels among the plurality of pixels (where each of a and b is a natural number), and the mura corrector generates 2×a number of pieces of the first compensation data for the first compensation block.

In an embodiment, the sampling corrector may generate four pieces of the second compensation data for a second compensation block that corresponds to the non-mura area among the plurality of compensation blocks.

According to an embodiment of the inventive concept, a display device includes: a display panel including a plurality of pixels respectively connected to a plurality of data lines and a plurality of scan lines; a data driving circuit configured to drive the plurality of data lines; a scan driving circuit configured to drive the plurality of scan lines; a memory configured to store compensation data including first compensation data and second compensation data; and a driving controller configured to receive a control signal and an image signal, control the data driving circuit and the scan driving circuit based on the control signal to display an image on the display panel, and provide the data driving circuit with an image data signal obtained by correcting the image signal based on the compensation data. The driving controller may correct a first image signal corresponding to a mura area of the display panel based on the first compensation data, provide a first corrected image signal as a first portion of the image data signal, correct a second image signal corresponding to a non-mura area of the display panel based on the second compensation data, and provide a second corrected image signal as a second portion of the image data signal.

In an embodiment, the plurality of pixels may be grouped into a plurality of compensation blocks, each of the plurality of compensation blocks may include a×b number of pixels among the plurality of pixels (where each of a and b is a natural number), and the first compensation data may include 2×a number of pieces of the compensation data corresponding to the mura area of the display panel.

In an embodiment, the driving controller may generate a×b number of pieces of the compensation data corresponding to the a×b number of pixels by linear interpolation based on the 2×a number of pieces of the compensation data corresponding to the mura area among the first compensation data, and the driving controller may correct the first image signal corresponding to the mura area of the display panel based on the a×b number of pieces of the compensation data and output a first portion of the image data signal.

In an embodiment, the plurality of pixels may be grouped into a plurality of compensation blocks, each of the plurality of compensation blocks may include a×b number of pixels among the plurality of pixels (where each of a and b is a natural number), and the second compensation data may include four pieces of the compensation data corresponding to the non-mura area of the display panel.

In an embodiment, the driving controller may generate a×b number of pieces of the compensation data corresponding to the a×b number of pixels by spatial interpolation based on the four pieces of the compensation data corresponding to the non-mura area among the second compensation data, and the driving controller may correct the second image signal corresponding to the non-mura area of the display panel based on the a×b number of pieces of the compensation data and output a second portion of the image data signal.

According to an embodiment of the inventive concept, a mura compensation method includes: generating a detected image signal based on an image displayed by a display panel; detecting a mura area of the display panel based on the detected image signal, and outputting position information of the mura area and a filtered image signal; performing deblurring on the filtered image signal based on the position information, and outputting a deblurred image signal; generating first compensation data for the mura area based on the deblurred image signal; generating second compensation data for a non-mura area of the display panel based on the detected image signal; storing the first compensation data and the second compensation data in a memory; correcting a first detected image signal corresponding to the mura area of the display panel among the detected image signal based on the first compensation data stored in the memory; providing a first corrected image signal as a first portion of an image data signal, correcting a second detected image signal corresponding to the non-mura area of the display panel among the detected image signal based on the second compensation data; providing a second corrected image signal as a second portion of the image data signal; and displaying the image data signal on the display panel based on the first corrected image signal and the second corrected image signal.

In an embodiment, the method may further include performing an erosion operation and a dilation operation based on a variable filter size and a filter shape.

In an embodiment, the method may further include grouping a plurality of pixels corresponding to the detected image signal into a plurality of areas; calculating a score for each of the plurality of areas based on a portion of the filtered image signal; and setting an area that has a highest score among scores of the plurality of areas as the mura area.

In an embodiment, the generating of the first compensation data may include: grouping a plurality of pixels corresponding to the detected image signal into a plurality of compensation blocks; and generating the first compensation data corresponding to a first compensation block corresponding to the mura area among the plurality of compensation blocks, wherein each of the plurality of compensation blocks may include a×b number of pixels among the plurality pixels (where each of a and b is a natural number), and the mura corrector may generate 2×a number of pieces of the first compensation data for the first compensation block.

BRIEF DESCRIPTION OF THE FIGURES

The accompanying drawings are included to provide a further understanding of the inventive concept, and are incorporated in and constitute a part of the present disclosure. The drawings illustrate exemplary embodiments of the present disclosure and, together with the description, serve to describe principles of the inventive concept. In the drawings.

DETAILED DESCRIPTION

Figure 1:
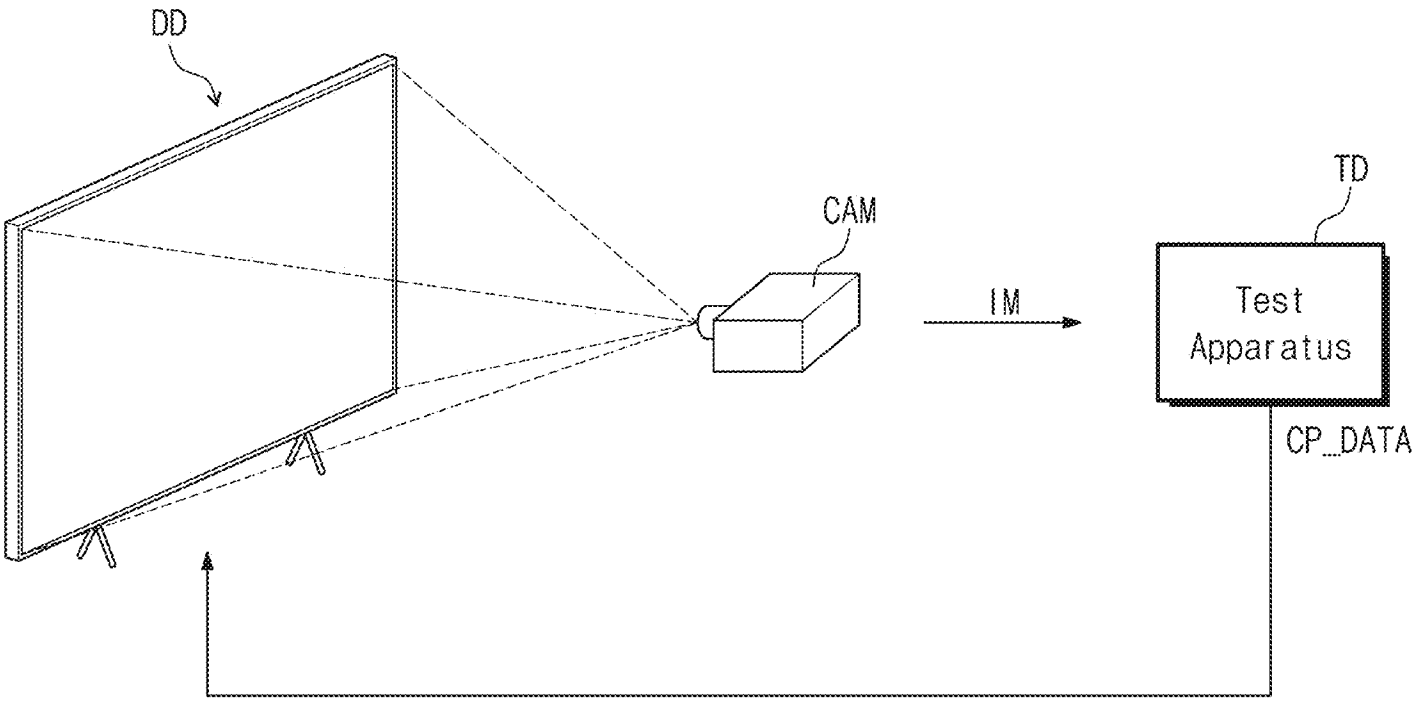
FIG. 1 illustrates a test system for testing a display panel according to an embodiment.

It will be understood that when an element or layer is referred to as being "on," "connected to," or "coupled to" another element or layer, it can be directly on, connected, or coupled to the other element or layer, or one or more intervening elements or layers may be present therebetween.

Like reference numerals refer to like elements throughout the present disclosure. In the figures, the thicknesses, ratios, and dimensions of elements are exaggerated for effective description and technical explanation. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the present disclosure. As used herein, singular forms such as "a," "an," and "the" are intended to include plural forms as well, unless the context clearly indicates otherwise.

Spatially relative terms such as "beneath," "below," "lower," "above," and "upper" may be used herein for ease of description for one element or feature's relationship to another element(s) or feature(s) as illustrated in the figures. It will be understood that the spatially relative terms are intended to encompass different orientations of the device in use or operation in addition to the orientation depicted in the figures.

It will be further understood that the terms "include" or "have" used in the present disclosure specify the presence of stated features, integers, steps, operations, elements, and/or components, but do not preclude the presence or addition of one or more other features, integers, steps, operations, elements, components, and/or groups thereof.

Unless expressly defined or stated otherwise, terms (including technical and scientific terms) used herein have the same meaning as commonly understood by one of ordinary skill in the art to which the present disclosure belongs. It will be further understood that terms such as those defined in commonly used dictionaries should be interpreted as having a meaning that is consistent with their meaning in the context of the relevant art and will not be interpreted in an idealized or overly formal sense unless expressly so defined herein.

Hereinafter, the present disclosure will be explained in detail with reference to the accompanying drawings.

FIG. 1 illustrates a test system for testing a display panel according to an embodiment.

Referring to FIG. 1, the test system includes a display device DD, a camera CAM, and a test apparatus TD. Although FIG. 1 illustrates a television as an example of the display device DD, the present disclosure is not limited thereto. The display device DD may be used not only in large-sized electronic devices such as a television and an outdoor digital signage, but also in small- and medium-sized electronic devices such as a personal computer, a laptop computer, a kiosk, a car navigation device, a camera, a tablet PC, a smartphone, a personal digital assistant (PDA), a portable multimedia player (PMP), a game machine, and a wrist watch-type electronic device.

As illustrated in FIG. 1, the camera CAM captures an image displayed on the display device DD and provides an image signal IM (a detected image signal) to the test apparatus TD. The test apparatus TD determines a mura area of the display device DD based on the image signal IM received from the camera CAM and generates compensation data CP_DATA for the mura area. The compensation data CP_DATA may be provided to the display device DD. The display device DD may correct an image data signal based on the compensation data CP_DATA and display a corrected image.

Figure 2:
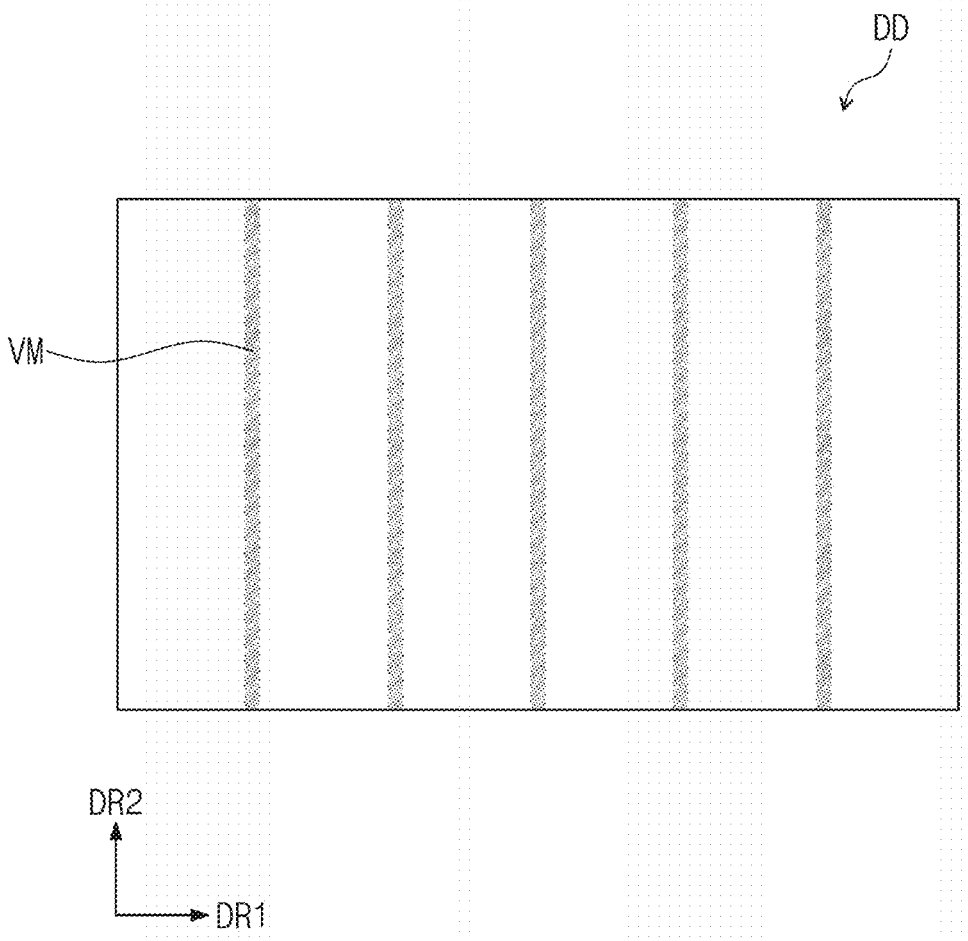
FIG. 2 exemplarily illustrates a mura displayed on a display device.

FIG. 2 exemplarily illustrates a mura displayed on the display device DD.

Referring to FIG. 2, the display device DD displays an image on a surface defined by a first direction DR1 and a second direction DR2. The display device DD may include a circuit pattern formed by a stepper during a manufacturing process. If an area that the stepper processes at a time is smaller than the surface area of the display device DD, a deviation of an amount of light exposure may occur due to overlapping light exposure, aberration of multiple lenses, and the like. The deviation of the amount of light exposure may change a width of the circuit pattern and cause a deviation of luminance of pixels due to a deviation of parasitic capacitance between thin film transistors, between signal wirings, and the like. The deviation of luminance may appear on the display device DD as a stepped mura. The stepped mura may have a shape of a horizontal line mura or a vertical line mura. The display device DD illustrated in FIG. 2 displays an example of a vertical line mura VM extending in the second direction DR2 and repeatedly appearing in the first direction DR1.

Figure 3:
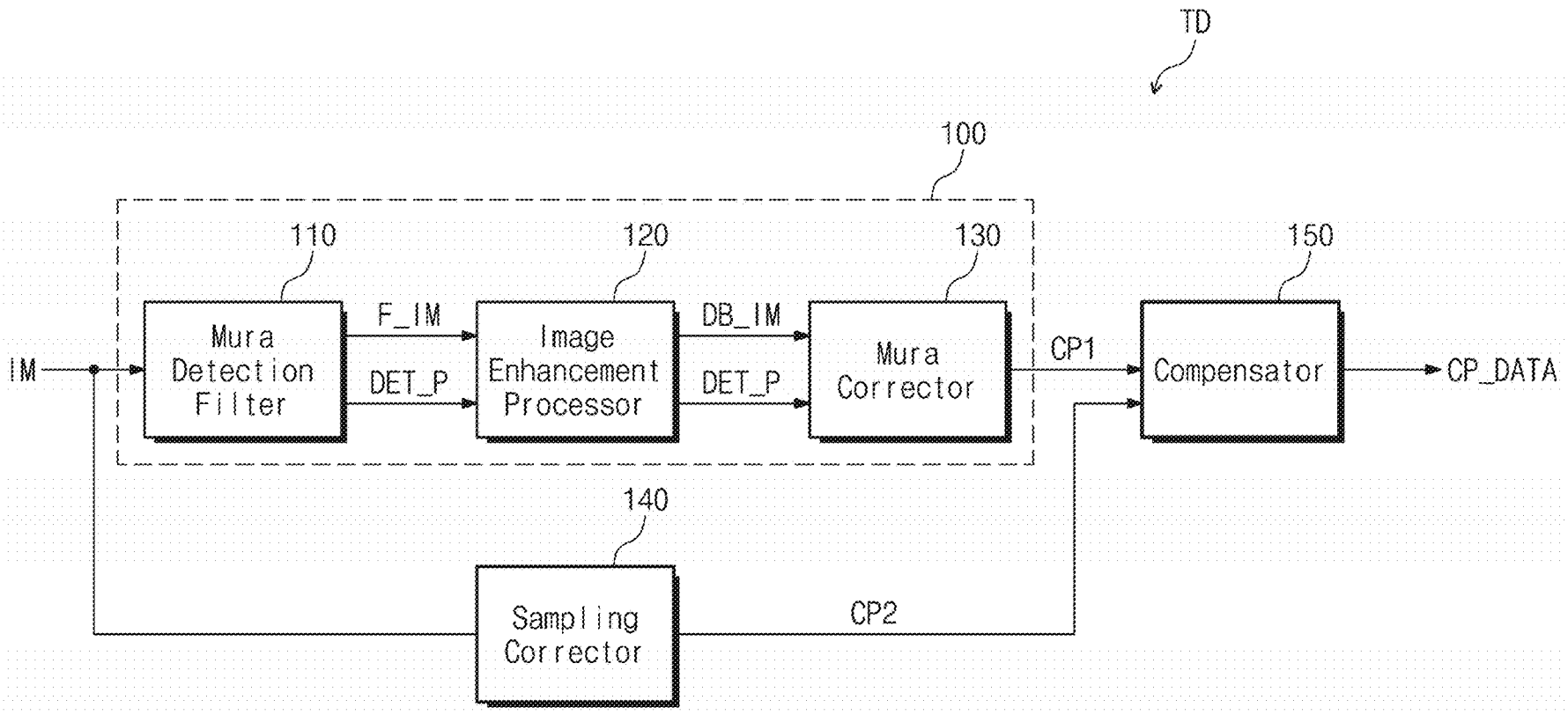
FIG. 3 is a block diagram of a test apparatus according to an embodiment.

FIG. 3 is a block diagram of a test apparatus according to an embodiment.

Referring to FIG. 3, the test apparatus TD includes a mura area corrector 100, a sampling corrector 140, and a compensator 150.

The mura area corrector 100 may detect a mura area based on the image signal IM (the detected image signal) received from the camera CAM (see FIG. 1) and generates first compensation data CP1 for the mura area. The mura area corrector 100 may include a mura detection filter 110, an image enhancement processor 120, and a mura corrector 130.

The mura detection filter 110 may detect a stepped vertical line mura area based on the image signal IM and outputs position information DET_P of the position of the detected stepped vertical line mura area. In addition, the mura detection filter 110 may perform filtering on the image signal IM and output a filtered image signal F_IM.

The image enhancement processor 120 may receive the position information DET_P and the filtered image signal F_IM from the mura detection filter 110. The image enhancement processor 120 may perform deblurring on the filtered image signal F_IM based on the position information DET_P, generate a deblurred image signal DB_IM, and provide the deblurred image signal DB_IM to the mura corrector 130.

The mura corrector 130 may generate the first compensation data CP1 based on the deblurred image signal DB_IM received from the image enhancement processor 120.

The sampling corrector 140 may generate second compensation data CP2 for the image signal IM.

The compensator 150 may receive the first compensation data CP1 from the mura area corrector 100 and the second compensation data CP2 from the sampling corrector 140 and generate the compensation data CP_DATA.

The mura detection filter 110, the image enhancement processor 120, and the mura corrector 130 will be described in further detail below.

Figure 4A:
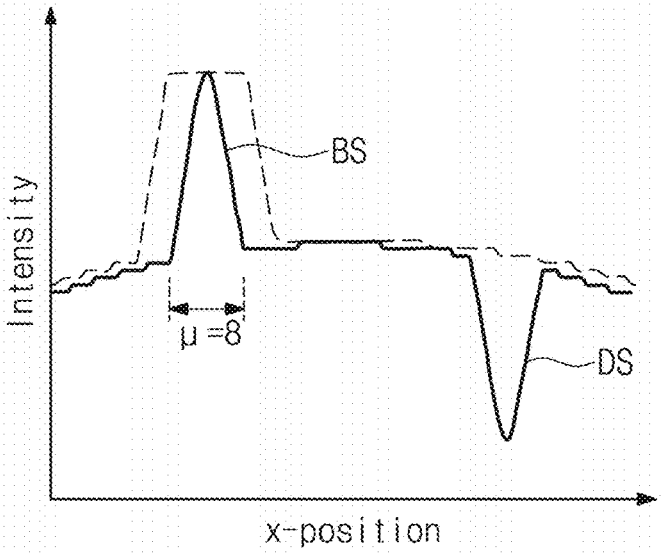
FIGS. 4A and 4B exemplarily show an operation of a mura detection filter according to an embodiment.
Figure 4B:
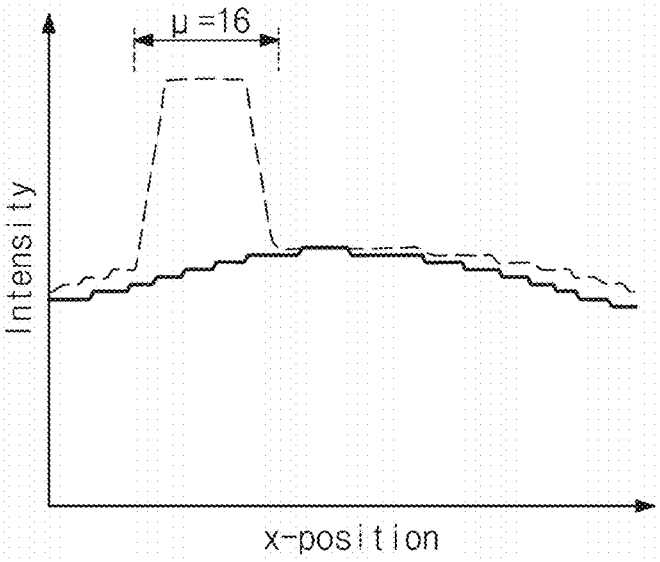

FIGS. 4A and 4B exemplarily show an operation of the mura detection filter 110 according to an embodiment.

Referring to FIGS. 4A and 4B, the mura detection filter 110 may detect a mura area using a morphology-pair. The morphology-pair may include an erosion operation and a dilation operation.

Equation 1 represents the erosion operation, and Equation 2 represents the dilation operation.

$$\varepsilon_{\mu B}(f)(x)=\wedge\{f(\gamma):\gamma\in\mu\check{B}_x\} \quad \text{[Equation 1]}$$

$$\delta_{\mu B}(f)(x)=\vee\{f(\gamma):\gamma\in\mu\check{B}_x\} \quad \text{[Equation 2]}$$

In Equations 1 and 2, x refers to a position of a pixel in the first direction DR1 (see FIG. 2), y refers to luminance (brightness), μ is a filter size, and $B_x$ is a filter shape.

Referring to FIG. 4A, when μ=8, that is, the filter size μ is equal to eight pixels, a bright stitch BS and a dark stitch DS may be detected after performing the erosion and dilation operations.

Referring to FIG. 4B, when μ=16, that is, the filter size μ is equal to 16 pixels, a stepped mura may not be detected because both the bright stitch BS and the dark stitch DS are removed after performing the erosion and dilation operations.

The sampling corrector 140 in FIG. 3 may not detect a stepped mura if a filter size is fixed. According to one embodiment, the mura area corrector 100 may vary the filter size (μ) to be able to detect a stepped mura.

Figure 5:
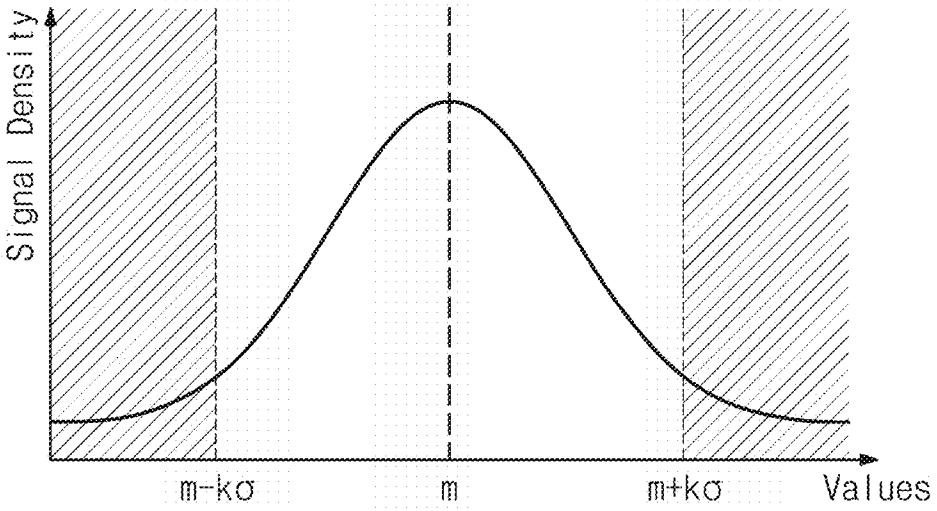
FIG. 5 is a normal distribution graph showing a filtered image signal outputted from a mura detection filter.
Figure 6:
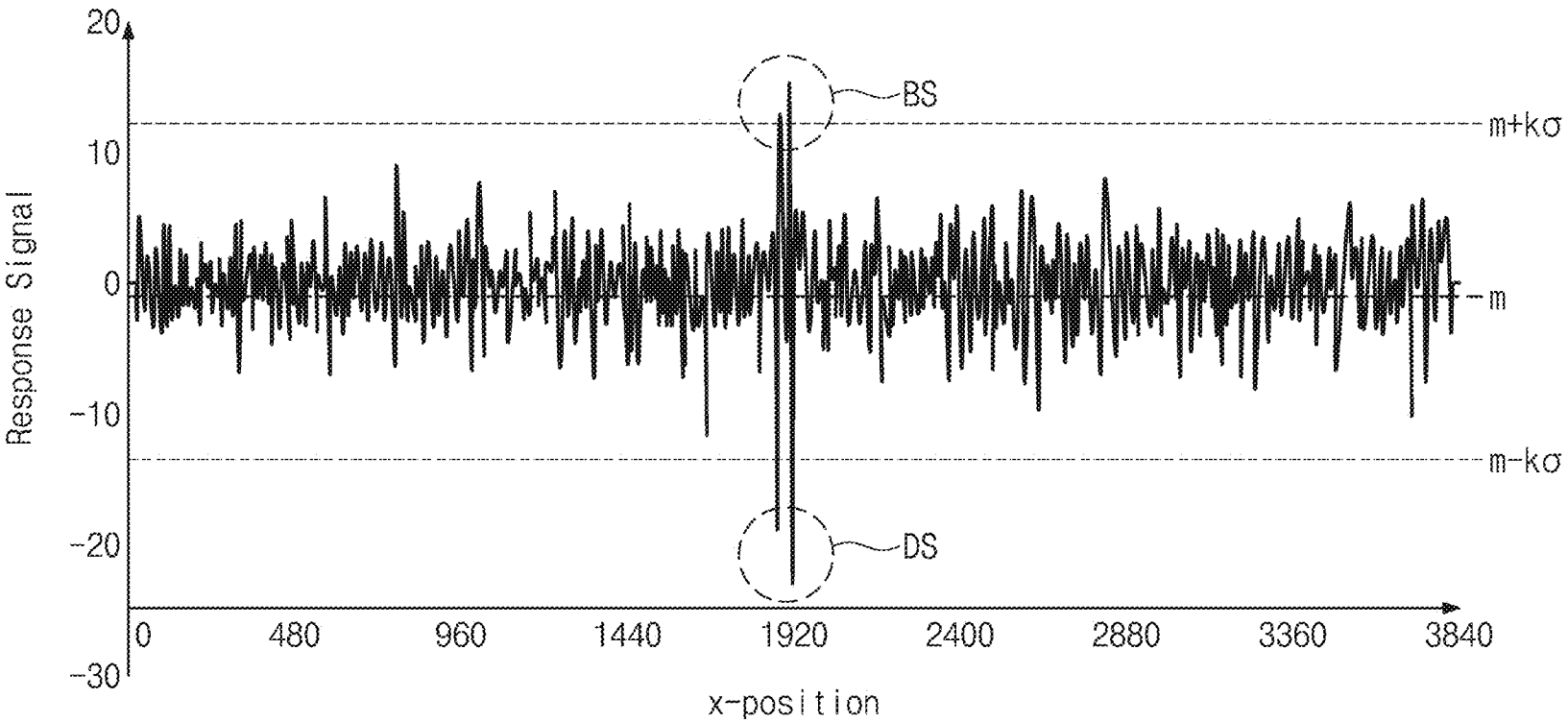
FIG. 6 exemplarily shows a filtered image signal outputted from a mura detection filter.

FIGS. 5 and 6 are example graphs for describing an operation of the mura detection filter 110.

FIG. 5 is a normal distribution graph showing the filtered image signal F_IM outputted from the mura detection filter 110. In the example shown in FIG. 5, a portion of the filtered image signal F_IM having a luminance value greater than a first reference value m+kσ may be classified as the bright stitch BS. In addition, a portion of the filtered image signal F_IM having a luminance value smaller than a second reference value m−kσ may be classified as the dark stitch DS. Here, m is a mean or average luminance, σ is a standard deviation, and k is a detection coefficient.

FIG. 6 exemplarily shows the filtered image signal F_IM outputted from the mura detection filter 110.

In the graph of FIG. 6, the abscissa represents the position x of a pixel in the first direction DR1 of the display device DD (see FIG. 2), and the ordinate represents the filtered image signal F_IM, also referred to as a response signal.

In the example shown in FIG. 6, the bright stitch BS and the dark stitch DS appear near 1920th pixels in the first direction DR1. The bright stitch BS and the dark stitch DS may appear as the vertical line mura VM on the display device DD as shown in FIG. 2.

Figure 7:
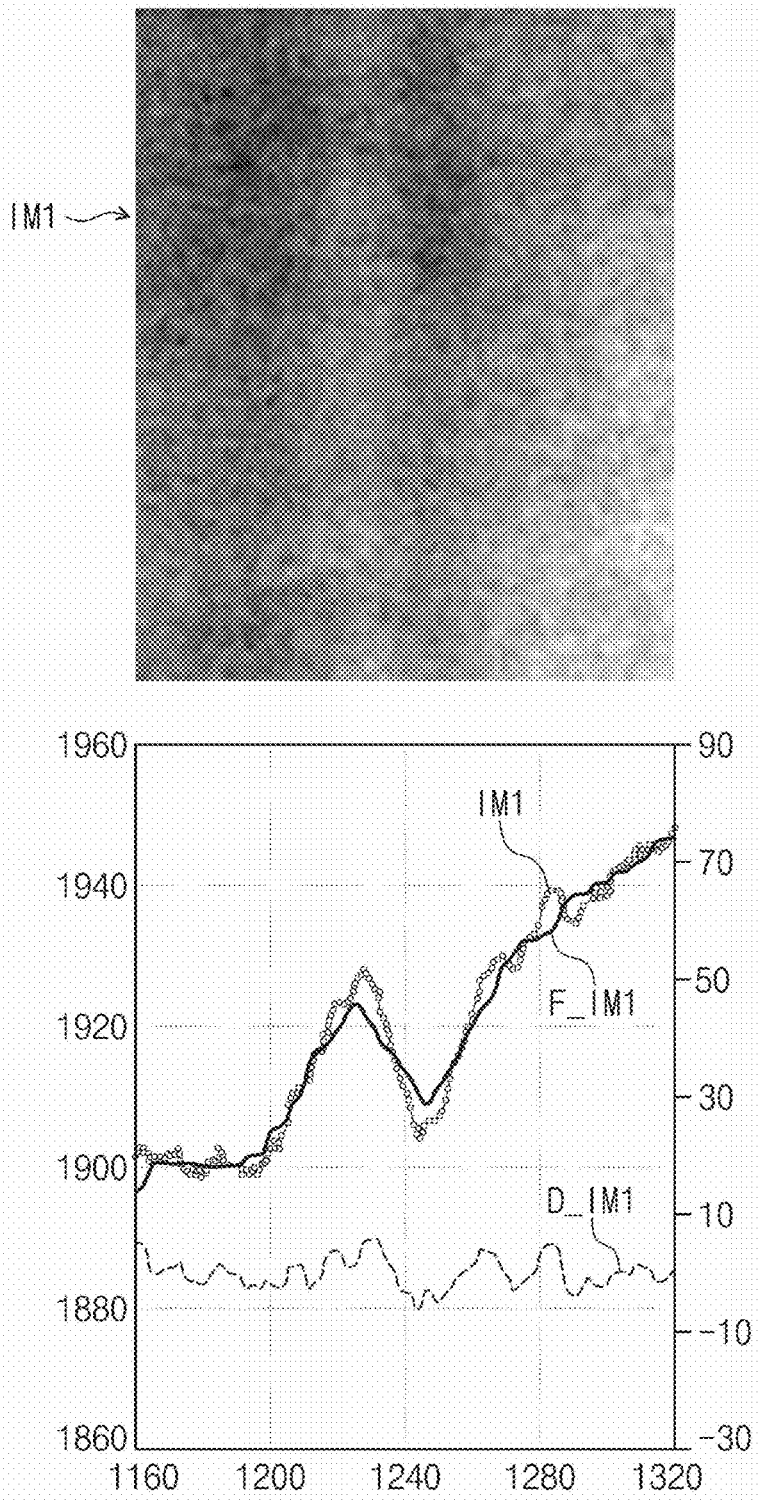
FIG. 7 exemplarily shows an operation of a mura detection filter for detecting a general vertical line mura displayed on a display device.

FIG. 7 exemplarily shows an operation of the mura detection filter 110 for detecting a general vertical line mura displayed on a display device.

Referring to FIGS. 1, 3, and 7, the camera CAM (see FIG. 1) may capture a first image displayed on the display device DD (see FIG. 1), generate a first image signal IM corresponding to the first image, and provide the first image signal IM1 to the mura detection filter 110 as the image signal IM. The mura detection filter 110 may perform filtering on the first image signal IM1 using the morphology-pair of Equations 1 and 2 and output a first filtered image signal F_IM1 as the filtered image signal F_IM.

As shown in FIG. 7, the first image displayed on the display device DD (see FIG. 1) includes a general vertical line mura, but a first difference value D_IM1 between the first image signal IM1 and the first filtered image signal F_IM1 may not have a large deviation when the first difference value D_IM1 is calculated in terms of the pixels. That is, the mura detection filter 110 may not classify the first filtered image signal F_IM1 as including a bright stitch and a dark stitch like the bright stitch BS and the dark stitch DS shown in FIG. 6.

Figure 8:
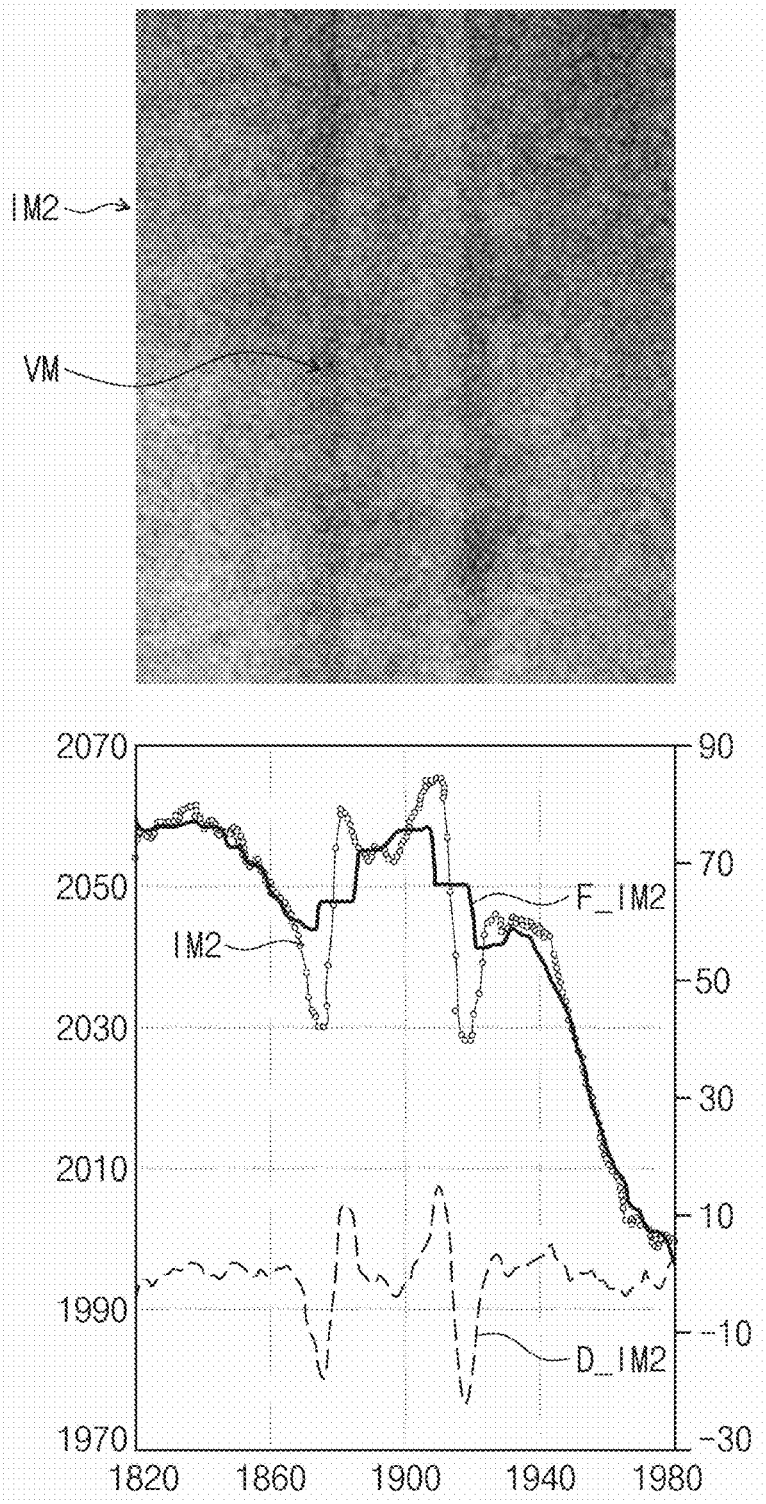
FIG. 8 exemplarily shows an operation of a mura detection filter for detecting a stepped vertical line mura displayed on a display device.

FIG. 8 exemplarily shows an operation of the mura detection filter 110 for detecting a stepped vertical line mura displayed on a display device.

Referring to FIGS. 3 and 8, the camera CAM (see FIG. 1) may capture a second image displayed on the display device DD (see FIG. 1), generate a second image signal IM2 corresponding to the second image, and provides the second image signal IM2 to the mura detection filter 110 as the image signal IM. The mura detection filter 110 may perform filtering on the second image signal IM2 using the morphology-pair of Equations 1 and 2 and output a second filtered image signal F_IM2 as the filtered image signal F_IM.

As shown in FIG. 8, the second image displayed on the display device DD (see FIG. 1) includes a stepped vertical line mura VM, and a second difference value D_IM2 between the second image signal IM2 and the second filtered image signal F_IM2 may have a large deviation when the difference value D_IM2 is calculated in terms of the pixels. That is, the mura detection filter 110 may classify the second difference value D_IM2 as including a difference bright stitch that corresponds to the bright stitch BS shown in FIG. 6 and a difference dark stitch that corresponds to the dark stitch DS shown in FIG. 6.

Figure 9:
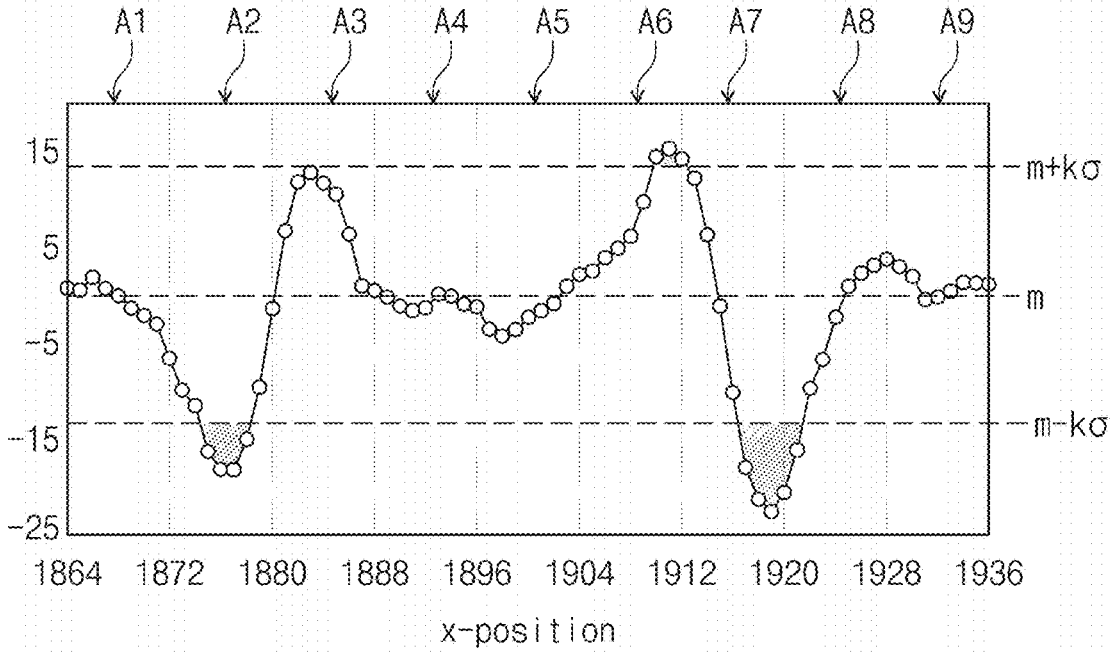
FIG. 9 exemplarily shows a method for detecting an area including a stepped vertical line mura.
Figure 10:
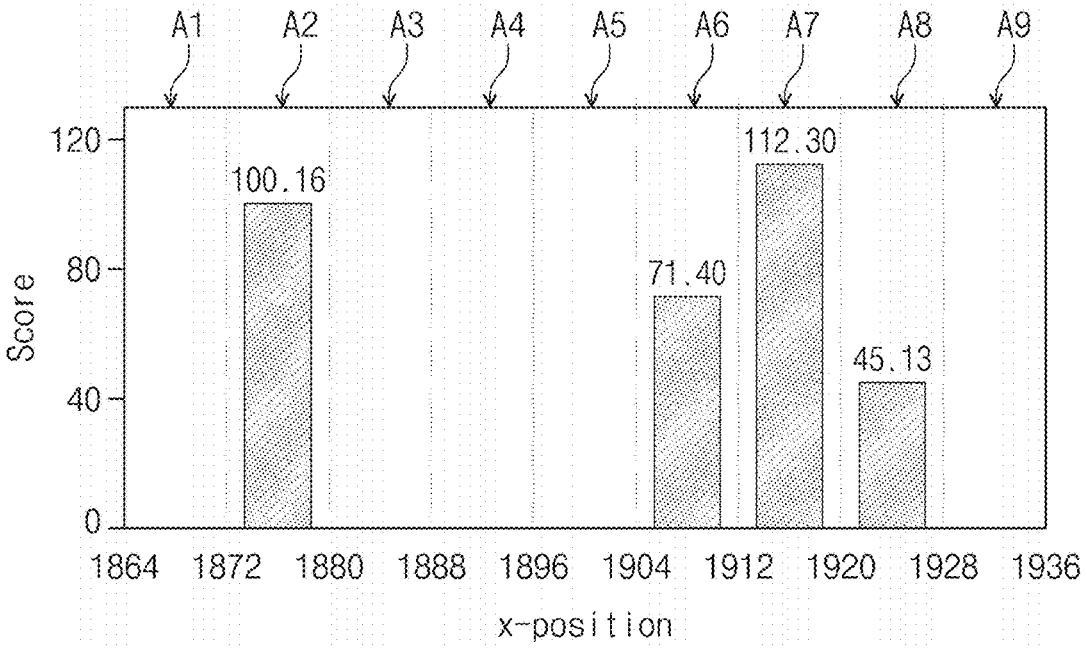
FIG. 10 is a graph showing a score for each of the first to ninth areas illustrated in FIG. 9.

FIGS. 9 and 10 exemplarily show a method for detecting an area including a stepped vertical line mura. FIG. 9 shows an enlarged view of the second difference value D_IM2 shown in FIG. 8 for convenience of description.

Referring to FIG. 9, the abscissa represents the position of a pixel in the first direction DR1 of the display device DD (see FIG. 2), and the ordinate represents a difference value D_IM (i.e., the second difference value D_IM2 of FIG. 8) between an image signal IM (i.e., the second image signal IM2 of FIG. 8) and a filtered image signal F_IM (i.e., the second filtered image signal F_IM2 of FIG. 8).

In FIG. 9, the pixels in the first direction DR1 of the display device DD (see FIG. 2) are grouped into first to ninth areas A1 to A9, each of which includes eight pixels.

FIG. 10 is a graph showing a score for each of the first to ninth areas A1 to A9 shown in FIG. 9.

According to one embodiment, scores of the first to ninth areas A1 to A9 may be respectively calculated using deviations between a mean luminance m and the difference value D_IM for the pixels included in the first to ninth areas A1 to A9. A mura score SC for each of the first to ninth areas A1 to A9 may be calculated by Equation 3.

$$SC=\int_x^{x+\mu}|D_\mathrm{IM}(x)|dx \quad \text{[Equation 3]}$$

In the example shown in FIGS. 9 and 10, the filter size μ is equal to 8.

The deviation between the second reference value m−kσ and the difference value D_IM for the pixels disposed from the 1912th column to the 1919th column in the seventh area A7 is largest, and the mura score SC for the seventh area A7 has the highest mura score of 112.30. Next, the deviation between the second reference value m−kσ and the difference value D_IM for the pixels disposed from the 1872nd column to the 1879th column in the second area A2 is the second largest, and the mura score SC for the second area A2 has the second highest mura score of 100.16.

The mura detection filter 110 may provide the image enhancement processor 120 with the filtered image signal F_IM and the position information DET_P for the two areas A7 and A2 with the two highest mura scores.

Figure 11A:
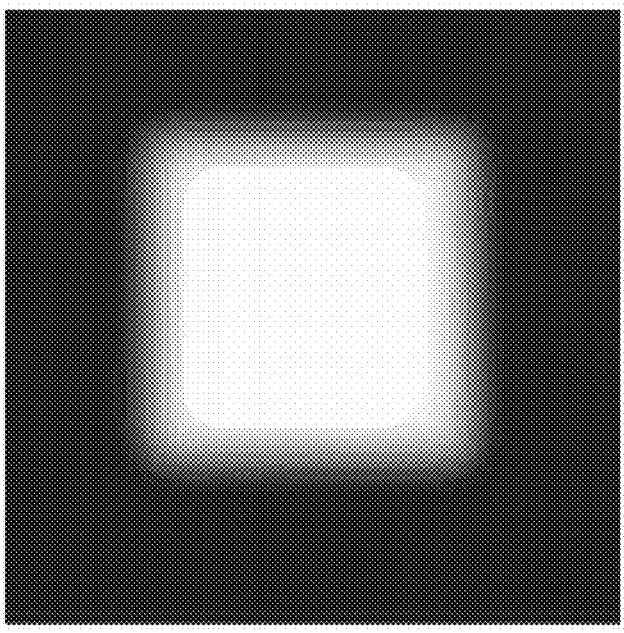
FIGS. 11A, 11B, and 11C describe an operation of an image enhancement processor according to an embodiment.
Figure 11B:
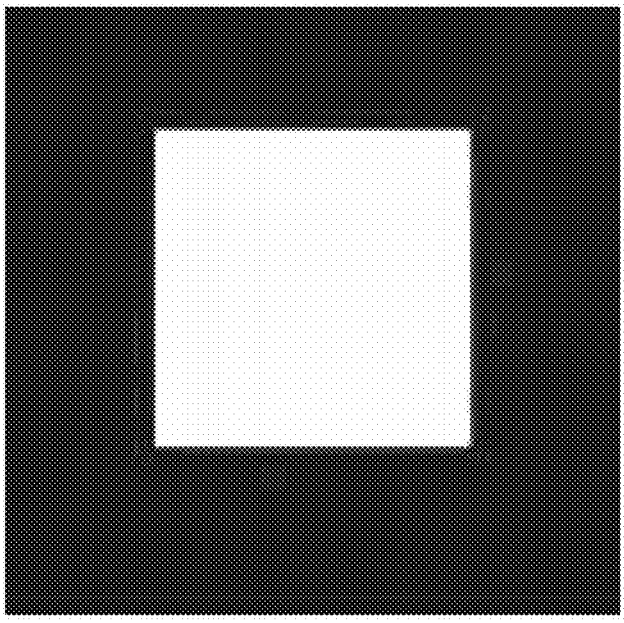
Figure 11C:
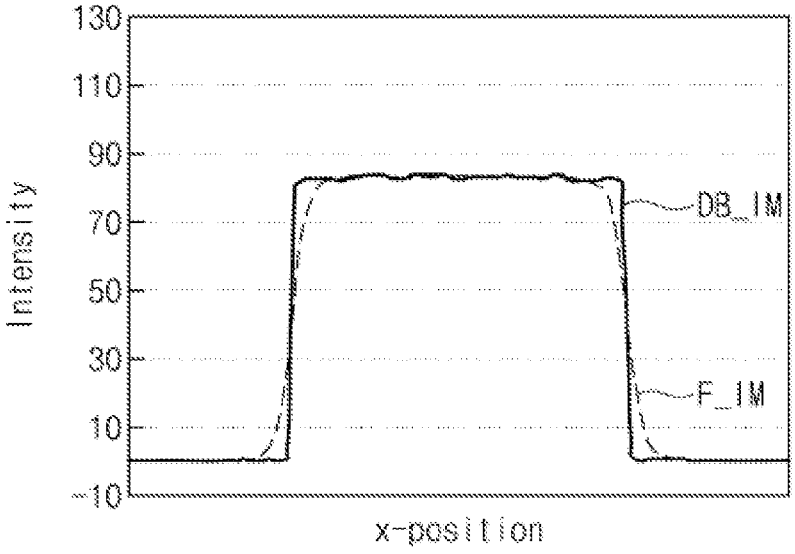

FIGS. 11A, 11B, and 11C are figures for describing an operation of the image enhancement processor 120 according to an embodiment. FIGS. 11A, 11B, and 11C are presented as an example for describing the operation of the image enhancement processor 120, and the present disclosure is not limited thereto.

Referring to FIGS. 1 and 11A, the image signal IM generated by the camera CAM (see FIG. 1) based on an image displayed on the display device DD may have a blurry contour, for example, a blurry boundary between black and white.

Referring to FIG. 3, the filtered image signal F_IM outputted from the mura detection filter 110 may also have a blurry contour as shown in FIG. 11A.

The image enhancement processor 120 may deblur the filtered image signal F_IM received from the mura detection filter 110 to correct the filtered image signal F_IM by reducing or removing the blurry contour, and output the deblurred image signal DB_IM.

FIG. 11B exemplarily shows the deblurred image signal DB_IM outputted from the image enhancement processor 120.

FIG. 11C is a graph showing a comparison of the filtered image signal F_IM outputted from the mura detection filter 110 and the deblurred image signal DB_IM outputted from the image enhancement processor 120.

As shown in FIG. 11C, gradation values may be clearly distinguished at a boundary between black and white in the deblurred image signal DB_IM compared with the filtered image signal F_IM.

According to one embodiment, the image enhancement processor 120 may obtain the deblurred image signal DB_IM by calculating the first derivative and the second derivative of the filtered image signal F_IM.

The deblurred image signal DB_IM outputted by the deblurring operation of the image enhancement processor 120 may be obtained by Equation 4.

$$I^{t(f(x,y))} = -\text{sign}(\Delta I^{t-1} f(x,y)) |\nabla I^{t-1}(f(x,y))| f(x,y), t \geq 0 \quad \text{[Equation 4]}$$

In Equation 4, f(x,y) represents the filtered image signal F_IM, and represents the deblurred image signal DB_IM. According to Equation 4, a boundary (edge) in the filtered image signal F_IM may be detected and clarified by a Laplacian operation $\Delta$ and a gradient operation $\nabla$.

The image shown in FIG. 11A may not be converted to the deblurred image shown in FIG. 11B by a single operation according to Equation 4, and the conversion may be achieved by iterating the operation of Equation 4 multiple times.

For example, the image enhancement processor 120 may iteratively perform the operation of Equation 4 until a difference ratio DR between a t-th deblurred image signal $I^{t(f(x,y))}$ and a (t−1)-th deblurred image signal $I^{t-1(f(x,y))}$ is equal to a predetermined value (e.g., about 0.03) or less.

The difference ratio DR may be calculated by Equation 5.

$$DR(t) = \max_{x,y}\left(\frac{I^t(f(x,y)) - I^{t-1}(f(x,y))}{I^{t-1}(f(x,y))}\right) \quad \text{[Equation 5]}$$

Referring back to FIG. 3, the image enhancement processor 120 may provide the mura corrector 130 with the deblurred image signal DB_IM and the position information DET_P that is received from the mura detection filter 110.

The mura corrector 130 may generate the first compensation data CP1 based on the deblurred image signal DB_IM received from the image enhancement processor 120. The mura corrector 130 may sufficiently remove a mura from the deblurred image signal DB_IM and generate the first compensation data CP1.

The mura corrector 130 may calculate the first compensation data CP1 by Equation 6.

$$CP1 = G_T - G_C \quad \text{[Equation 6]}$$

$$G_T = I_M(I_T(G_C))^{-1}$$

$$I_T = \left(\frac{G_C}{max_{Gray}}\right)^{\gamma_Target} \times max_{Intensity}$$

$$I_M = \left(\frac{G_C}{max_{Gray}}\right)^{\gamma_Mura} \times max_{Intensity}$$

In Equation 6, $G_T$ is a compensation target gradation, $G_C$ is a compensation gradation, $I_T$ and $I_M$ are respectively gradation-to-luminance conversion formulas for the compensation target gradation $G_T$ and the image signal IM including a vertical line mura, $max_{gray}$ is a maximum gradation, and $max_{intensity}$ is maximum luminance in full-white.

The sampling corrector 140 may generate the second compensation data CP2 for the image signal IM. The sampling corrector 140 may generate the second compensation data CP2 based on a difference between a gradation of a test image (also referred to as a target gradation) and a gradation of the image signal IM.

The compensator 150 may add the first compensation data CP1 received from the mura corrector 130 and the second compensation data CP2 received from the sampling corrector 140 to generate the compensation data CP_DATA.

Figure 12:
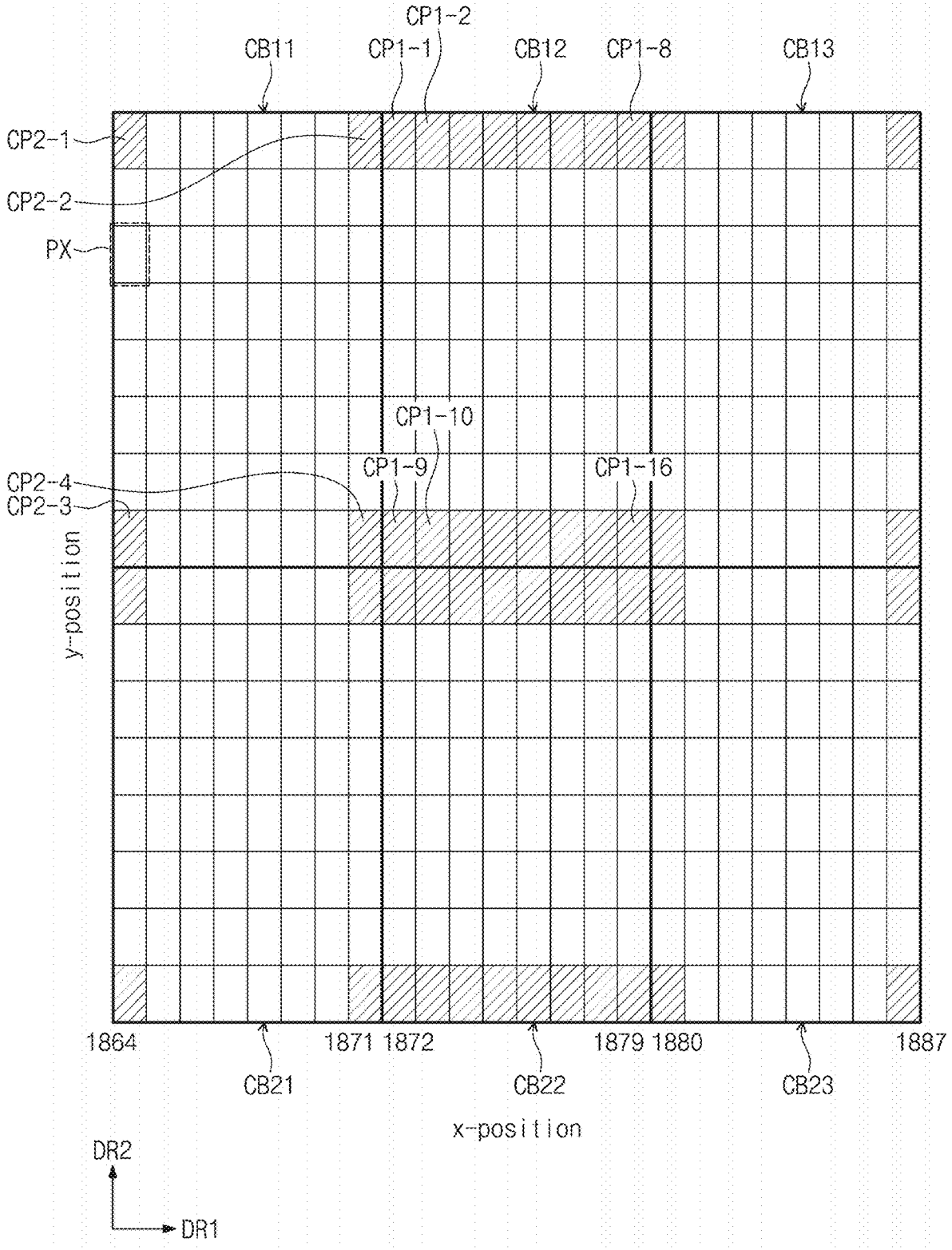
FIG. 12 exemplarily illustrates compensation data generated in a compensator according to an embodiment.

FIG. 12 exemplarily illustrates compensation data generated in the compensator 150 according to an embodiment.

Cells illustrated in FIG. 12 respectively represent pixels PX. A pixel group in the form of a matrix including "a" number of pixels in the first direction DR1 and "b" number of pixels in the second direction DR2 among the pixels PX may form one compensation block (here, each of a and b is a natural number). In FIG. 12, compensation blocks CB11 to CB13 and CB21 to CB23 are illustrated as an example. Each of the compensation blocks CB11 to CB13 and CB21 to CB23 includes a×b number of pixels. In an embodiment, each of a and b is equal to 8 (a=b=8).

In FIG. 10, the second area A2 including pixels disposed from the 1872nd column to the 1879th column in the first direction DR1 is determined as a mura area due to its mura score SC having a high value than a threshold value.

Referring to FIG. 12, it is assumed that the pixels disposed from the 1872nd column to the 1879th column in the first direction DR1 are included in the compensation blocks CB12 and CB22. That is, each of the compensation blocks CB12 and CB22 is a mura area in which a stepped vertical line mura may be displayed. Further, the mura corrector 130 may generate the first compensation data CP1 for the compensation blocks CB12 and CB22.

In the present example, the mura corrector 130 may generate 2×a, that is, 16 pieces of the first compensation data CP1 for one of the compensation blocks CB12 and CB22. For example, the compensation block CB12 may include 16 pieces of the first compensation data CP1-1 to CP1-16.

The pixels disposed from the 1864th column to the 1871st column in the first direction DR1 are included in the compensation blocks CB11 and CB21. The pixels disposed from the 1880th column to the 1887th column in the first direction DR1 are included in the compensation blocks CB13 and CB23. That is, the compensation blocks CB11, CB21, CB13, and CB23 correspond to a non-mura area that may not include a stepped vertical line mura. That is, the sampling corrector 140 may generate the second compensation data CP2 for compensation blocks CB11, CB21, CB13, and CB23.

In the present example, the sampling corrector 140 may generate four pieces of the second compensation data CP2 for one of the compensation blocks CB11, CB21, CB13, and CB23. For example, the compensation block CB11 may include four pieces of the second compensation data CP2-1 to CP2-4.

The area displaying a stepped vertical line mura, that is, the compensation blocks CB12 and CB22 corresponds to more pieces of the compensation data CP_DATA than other compensation blocks CB11, CB21, CB13, and CB23 that display no stepped vertical line mura. A method of compensating an image using the compensation data CP_DATA will be described in further detail below.

Figure 13:
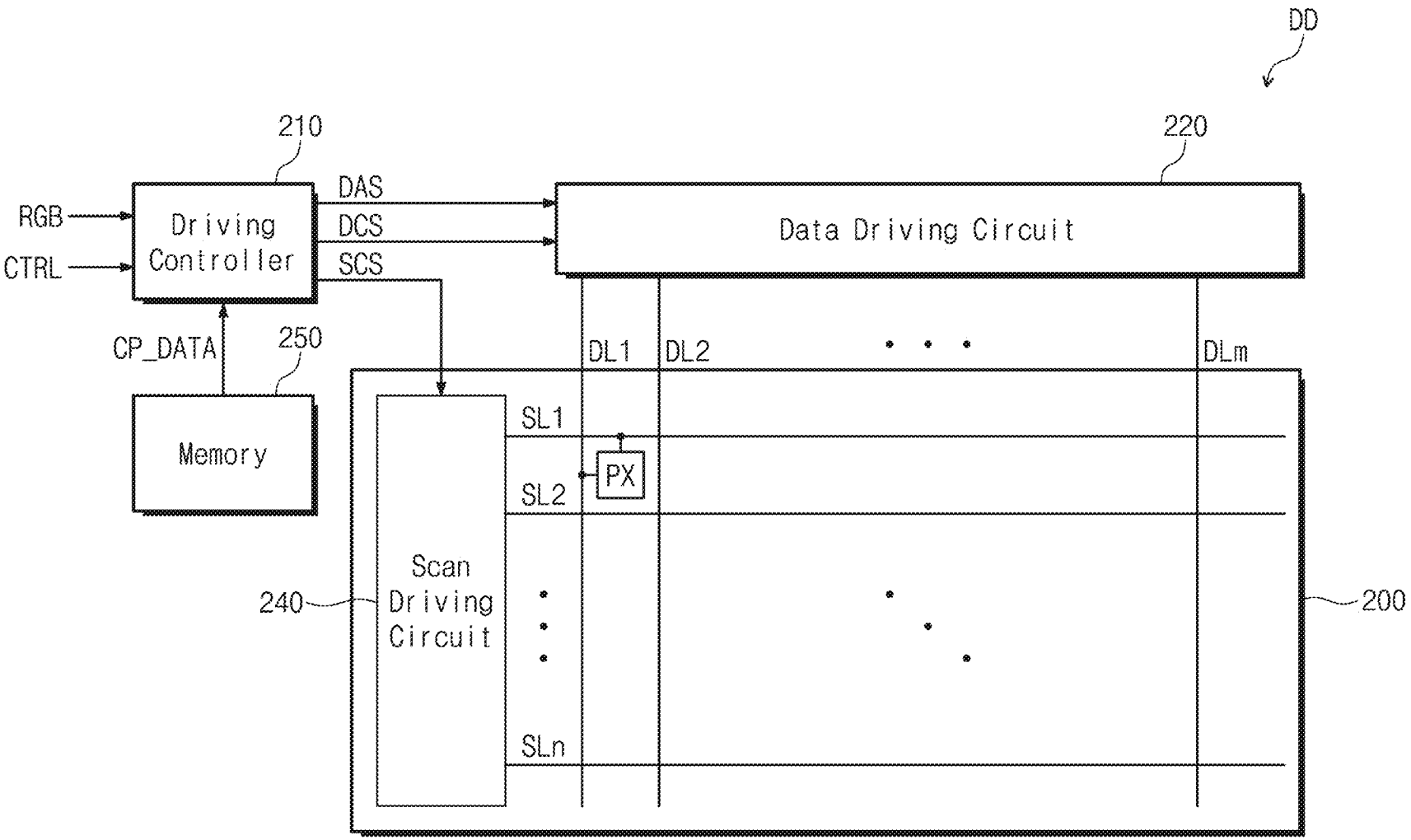
FIG. 13 exemplarily illustrates a display device according to an embodiment.

FIG. 13 exemplarily illustrates the display device DD according to an embodiment.

Referring to FIG. 13, the display device DD includes a display panel 200, a driving controller 210, a data driving circuit 220, and a memory 250.

The display panel 200 includes a scan driving circuit 240, the plurality of pixels PX, a plurality of data lines DL1 to DLm, and a plurality of scan lines SL1 to SLn. Each of the plurality of pixels PX is connected to a corresponding data line among the plurality of data lines DL1 to DLm and a corresponding scan line among the plurality of scan lines SL1 to SLn.

The display panel 200 displaying an image may be one of various types of display panels including, but not limited to, a liquid crystal display (LCD) panel, an electrophoretic display panel, an organic light emitting diode (OLED) panel, a light emitting diode (LED) panel, an inorganic electroluminescent (EL) display panel, a field emission display (FED) panel, a surface-conduction electron-emitter display (SED) panel, a plasma display panel (PDP), and a cathode ray tube (CRT) display panel.

The driving controller 210 receives an input image signal RGB and a control signal CTRL. The control signal CTRL may include, but is not limited to, a synchronization signal and a clock signal. The driving controller 210 provides the data driving circuit 220 with an image data signal DAS that is generated by processing the input image signal RGB according to an operating condition of the display panel 200. Based on the control signal CTRL, the driving controller 210 provides a first control signal DCS to the data driving circuit 220 and provides a second control signal SCS to the scan driving circuit 240. The first control signal DCS may include, but is not limited to, a horizontal synchronization start signal, a clock signal, and a line latch signal, and the second control signal SCS may include, but is not limited to, a vertical synchronization start signal and an output enable signal.

The data driving circuit 220 may output gradation voltages for driving the plurality of data lines DL1 to DLm in response to the first control signal DCS and the image data signal DAS received from the driving controller 210. In an exemplary embodiment, the data driving circuit 220 may be implemented as an integrated circuit (IC) to be directly mounted on a predetermined area of the display panel 200 or may be mounted on a separate printed circuit board in the form of a chip on film (COF) to be electrically connected to the display panel 200. In another embodiment, the data driving circuit 220 may be formed on a display panel 200 in the same process as a driving circuit of the pixels PX.

The scan driving circuit 240 may drive the plurality of scan lines SL1 to SLn in response to the second control signal SCS received from the driving controller 210. In an exemplary embodiment, the scan driving circuit 240 may be formed on the display panel 200 in the same process as the driving circuit of the pixels PX, but the present disclosure is not limited thereto. For example, the scan driving circuit 240 may be implemented as an integrated circuit (IC) to be directly mounted on a predetermined area of the display panel 200 or may be mounted on a separate printed circuit board in the form of a chip on film (COF) to be electrically connected to the display panel 200.

The memory 250 stores the compensation data CP_DATA. The compensation data CP_DATA stored in the memory 250 may be provided by the test apparatus TD illustrated in FIG. 3. The compensation data CP_DATA may include the first compensation data CP1 and the second compensation data CP2.

The driving controller 210 may correct the input image signal RGB based on the compensation data CP_DATA stored in the memory 250 and may provide the corrected image data signal DAS to the data driving circuit 220.

Figure 14:
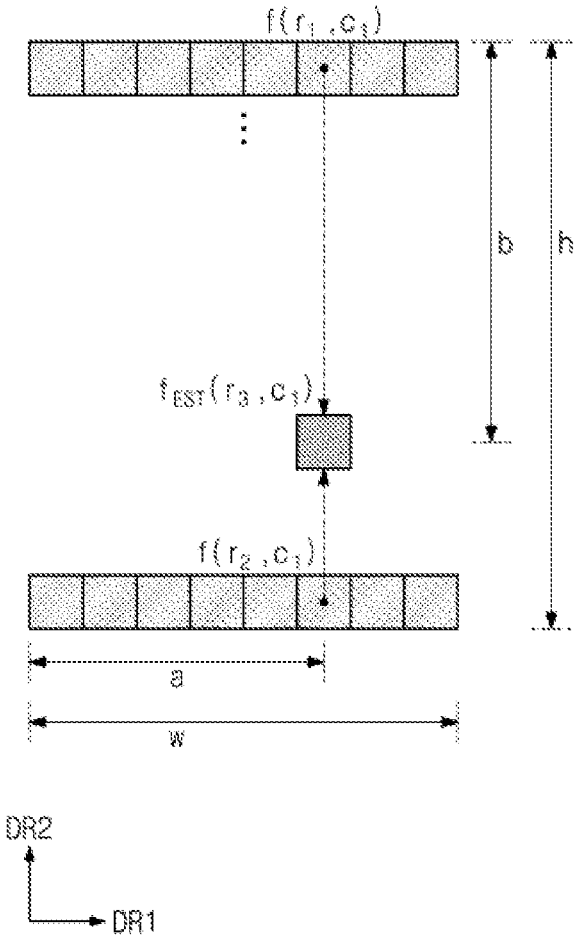
FIG. 14 illustrates a method for interpolating compensation data for a mura area according to an embodiment.

FIG. 14 illustrates a method for interpolating compensation data for a mura area according to an embodiment.

Referring to FIGS. 12, 13, and 14, each of the compensation blocks CB12 and CB22 corresponding to a mura area includes 16 pieces of the first compensation data CP1-1 to CP1-16. The driving controller 210 may use the 16 pieces of the first compensation data CP1-1 to CP1-16 to generate the compensation data CP_DATA corresponding to 8×8 pixels, that is, 64 pixels by linear interpolation.

For example, the driving controller 210 may calculate a piece of the compensation data CP_DATA corresponding to the pixel PX at a position (r3, c1) using Equation 7.

$$f_{Est}(r_3, c_1) = \left[\left\{\frac{b}{h} * f(r_1, c_1)\right\} + \left\{\left(\frac{1-b}{h}\right) * f(r_2, c_1)\right\}\right] \quad \text{[Equation 7]}$$

The compensation data corresponding to the pixel PX at the position (r3, c1) is interpolated based on the compensation data corresponding to the pixels PX at the positions (r1, c1) and (r2,c1) according to their linear distances therefrom.

Figure 15:
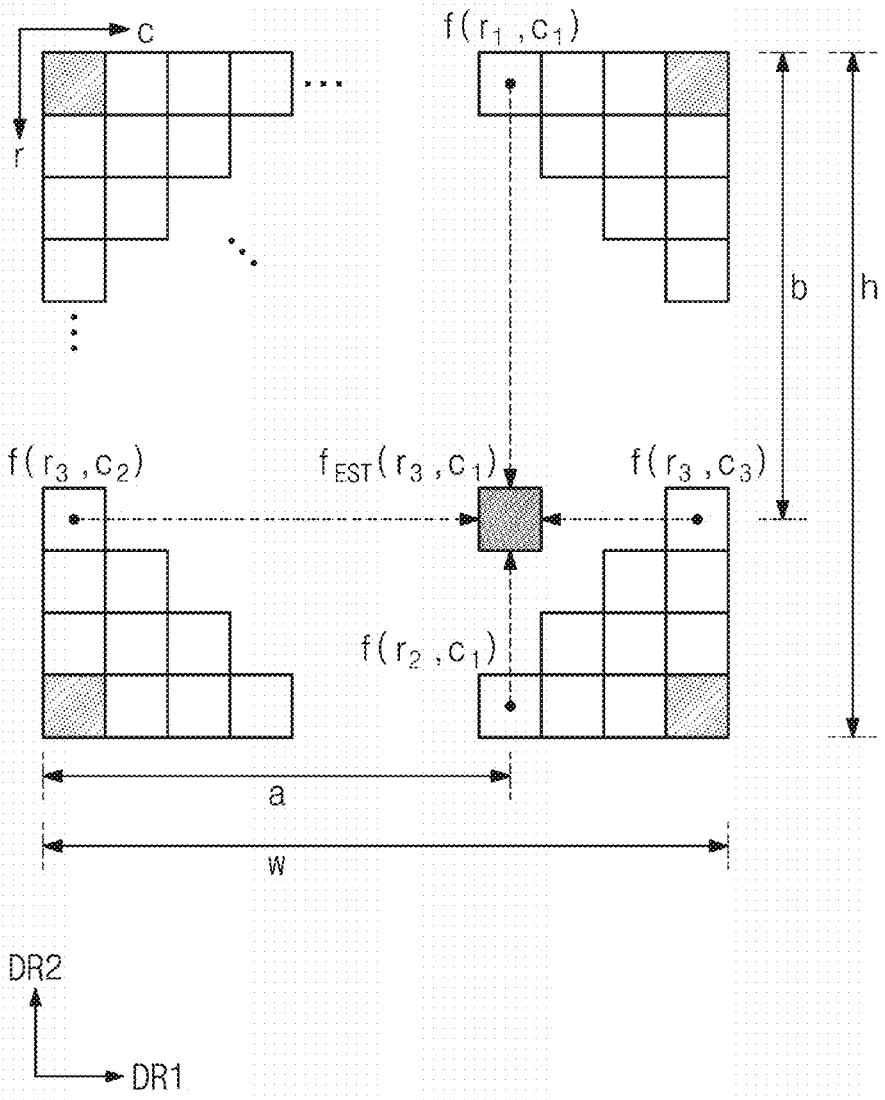
FIG. 15 illustrates a method for interpolation compensation data for a non-mura area according to an embodiment.

FIG. 15 illustrates a method for interpolating compensation data for a non-mura area according to an embodiment.

Referring to FIGS. 12, 13, and 15, each of the compensation blocks CB11, CB21, CB13, and CB23 corresponding to a non-mura area includes four pieces of second compensation data CP2-1 to CP2-4. The driving controller 210 uses the four pieces of the second compensation data CP2-1 to CP2-4 to generate the compensation data CP_DATA corresponding to 8×8 pixels, that is, 64 pixels by spatial interpolation.

For example, the driving controller 210 may calculate a piece of the compensation data CP_DATA corresponding to the pixel PX at a position (r3, c1) based on the four pieces of second compensation data CP2-1 to CP2-4 using Equation 8.

$$f_{Est}(r_3, c_1) = \left[\begin{array}{l} \left\{\frac{a}{w} * f(r_3, c_2)\right\} * \left\{\left(\frac{1-a}{w}\right) * f(r_3, c_3)\right\} + \\ \left\{\frac{b}{h} * f(r_1, c_1)\right\} + \left\{\left(\frac{1-b}{h}\right) * f(r_2, c_1)\right\} \end{array}\right] \quad \text{[Equation 8]}$$

First, four intermediate compensation data corresponding to the pixels PX at the positions (r1, c1), (r2, c1), (r3, c2), and (r3,c3) are interpolated based on the four pieces of second compensation data CP2-1 to CP2-4, and the compensation data corresponding to the pixel PX at the position (r3, c1) is interpolated based on the four intermediate compensation data corresponding to the pixels PX at the positions (r1, c1), (r2, c1), (r3, c2), and (r3,c3) according to their distances therefrom.

Figure 16:
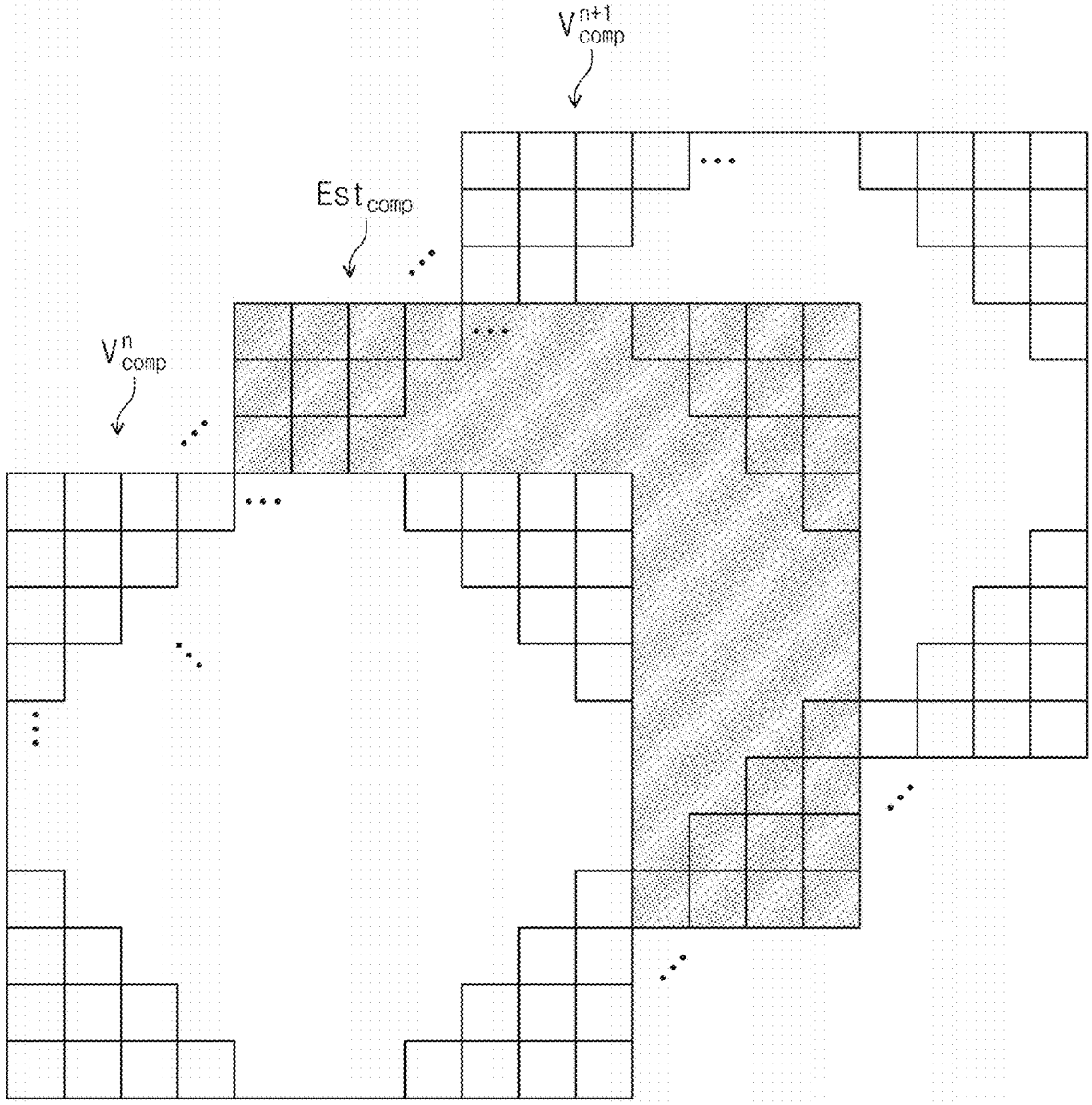
FIG. 16 illustrates a method for interpolating gradation according to an embodiment.

FIG. 16 illustrates a method for interpolating gradation according to an embodiment.

The test apparatus TD illustrated in FIG. 1 may test a vertical line mura for some of gradations instead of testing a vertical line mura for all of the gradations, and the driving controller 210 may calculate the compensation data CP_DATA for the remaining gradations in the linear interpolation method.

The driving controller 210 may use compensation data $V_{Comp}^{n}$ for an n-th gradation $G_C^{n}$ and compensation data $V_{Comp}^{n+1}$ for an (n+1)-th gradation $G_C^{n+1}$ to generate estimated compensation data $Est_{Comp}$ for a gradation $G_C^{Est}$ between the n-th gradation and the (n+1)-th gradation.

The driving controller 210 may calculate the estimated compensation data $Est_{Comp}$ using Equation 9.

$$Est_{Comp} = V_{Comp}^{n} + \left(V_{Comp}^{n+1} - V_{Comp}^{n}\right)\frac{G_C^{Est} - G_C^{n}}{G_C^{n+1} - G_C^{n}} \quad \text{[Equation 9]}$$

In Equation 9, n is a natural number.

The test apparatus TD described herein may detect a deviation of a characteristic of the pixels and generate the compensation data CP_DATA for an area having a mura within a display area of the display device DD. In particular, the test apparatus TD may generate the compensation data CP_DATA by more accurately detecting a mura area through a morphological filter and performing deblurring on the mura area. Furthermore, the test apparatus TD may improve mura compensation performance of the display device DD by increasing the number of pieces of the compensation data CP_DATA corresponding to a mura area compared with a non-mura area.

Although the exemplary embodiments of the inventive concept have been described herein, it is understood that various changes and modifications can be made by those skilled in the art within the spirit and scope of the inventive concept including the following claims or the equivalents. The exemplary embodiments described herein are not intended to limit the technical spirit and scope of the present disclosure, and technical spirit within the scope of the following claims or the equivalents will be construed as being included in the scope of the present disclosure.

What is claimed is:

1. A test apparatus comprising:

a mura detection filter configured to detect a mura area based on a detected image signal, and output position information of the mura area and a filtered image signal;

an image enhancement processor configured to perform deblurring on the filtered image signal based on the position information, and output a deblurred image signal;

a mura corrector configured to generate first compensation data for the mura area based on the deblurred image signal;

a sampling corrector configured to generate second compensation data for a non-mura area based on the detected image signal; and a compensator configured to output compensation data based on the first compensation data and the second compensation data.

2. The test apparatus of claim 1, wherein the mura detection filter detects the mura area by performing an erosion operation and a dilation operation on the detected image signal.

3. The test apparatus of claim 2, wherein the mura detection filter performs the erosion operation and the dilation operation based on a variable filter size and a filter shape.

4. The test apparatus of claim 1, wherein the mura detection filter is further configured to:

group a plurality of pixels corresponding to the detected image signal into a plurality of areas;

calculate a score for each of the plurality of areas based on a portion of the filtered image signal corresponding to each of the plurality of areas; and set an area that has a highest score among scores of the plurality of areas as the mura area.

5. The test apparatus of claim 4, wherein the mura detection filter is further configured to:

calculate the filtered image signal by an erosion operation and a dilation operation on the detected image signal; and calculate a difference value between the detected image signal and the filtered image signal;

calculate a score for each of the plurality of areas based on a deviation between the difference value corresponding to each of the plurality of areas and a reference value.

6. The test apparatus of claim 5, wherein the reference value comprises a first reference value and a second reference value, the first reference value is $m+k\sigma$, and the second reference value is $m-k\sigma$, and m is average luminance of the filtered image signal, k is a detection coefficient, and $\sigma$ is a standard deviation.

7. The test apparatus of claim 4, wherein the image enhancement processor performs the deblurring on the filtered image signal in an area corresponding to the position information among the plurality of areas.

8. The test apparatus of claim 1, wherein the image enhancement processor performs the deblurring on the filtered image signal using an equation $$I^{t(f(f(x,y))} = -\mathrm{sign}(\Delta I^{t-1} f(x,y))|\nabla I^{t-2}(f(x,y))|f(x,y), t \geq 0, \text{ and}$$

wherein f(x,y) is the filtered image signal, $I^{t(f(x,y))}$ is a t-th deblurred image signal, and $I^{t-1(f(x,y))}$ is a (t−1)-th deblurred image signal.

9. The test apparatus of claim 8, wherein the image enhancement processor iteratively calculates the equation until a difference ratio between the t-th deblurred image signal and the (t−1)-th deblurred image signal is equal to or less than a predetermined value.

10. The test apparatus of claim 1, wherein the mura corrector is further configured to:

group a plurality of pixels corresponding to the detected image signal into a plurality of compensation blocks; and generate the first compensation data corresponding to a first compensation block that corresponds to the mura area among the plurality of compensation blocks, wherein the first compensation block includes a×b number of pixels among the plurality of pixels (where each of a and b is a natural number), and wherein the mura corrector generates 2×a number of pieces of the first compensation data for the first compensation block.

11. The test apparatus of claim 10, wherein the sampling corrector generates four pieces of the second compensation data for a second compensation block that corresponds to the non-mura area among the plurality of compensation blocks.

12. A display device comprising:

a display panel including a plurality of pixels respectively connected to a plurality of data lines and a plurality of scan lines;

a data driving circuit configured to drive the plurality of data lines;

a scan driving circuit configured to drive the plurality of scan lines;

a memory configured to store compensation data including first compensation data and second compensation data; and a driving controller configured to receive a control signal and an image signal, control the data driving circuit and the scan driving circuit based on the control signal to display an image on the display panel, and provide the data driving circuit with an image data signal obtained by correcting the image signal based on the compensation data, wherein the driving controller generates a×b number of pieces of first interpolation compensation data corresponding to a×b number of pixels by linear interpolation based on the 2×a number of pieces of the compensation data corresponding to a mura area among the first compensation data, wherein the driving controller corrects a first image signal corresponding to the mura area of the display panel among the image signal based on a×b number of pieces of the first interpolation compensation data and a first portion of the image data signal, and wherein the driving controller corrects a second image signal corresponding to a non-mura area of the display panel among the image signal based on the second compensation data, and outputs a second portion of the image data signal.

13. The display device of claim 12, wherein the plurality of pixels is grouped into a plurality of compensation blocks, and each of the plurality of compensation blocks includes the a×b number of pixels among the plurality of pixels (where each of a and b is a natural number).

14. The display device of claim 12, wherein the driving controller generates a×b number of pieces of second interpolation compensation data corresponding to the a×b number of pixels by spatial interpolation based on four pieces of the compensation data corresponding to the non-mura area among the second compensation data, and the driving controller corrects the second image signal based on the a×b number of pieces of the second interpolation compensation data and outputs the second portion of the image data signal.

15. A mura compensation method comprising:

generating a detected image signal based on an image displayed by a display panel;

detecting a mura area of the display panel based on the detected image signal, and outputting position information of the mura area and a filtered image signal;

performing deblurring on the filtered image signal based on the position information, and outputting a deblurred image signal;

generating first compensation data for the mura area based on the deblurred image signal;

generating second compensation data for a non-mura area of the display panel based on the detected image signal;

storing the first compensation data and the second compensation data in a memory;

correcting a first detected image signal corresponding to the mura area of the display panel among the detected image signal based on the first compensation data stored in the memory;

providing a first corrected image signal as a first portion of an image data signal;

correcting a second detected image signal corresponding to the non-mura area of the display panel among the detected image signal based on the second compensation data;

providing a second corrected image signal as a second portion of the image data signal; and displaying the image data signal on the display panel based on the first corrected image signal and the second corrected image signal.

16. The mura compensation method of claim 15, further comprising performing an erosion operation and a dilation operation based on a variable filter size and a filter shape.

17. The mura compensation method of claim 15, further comprising:

grouping a plurality of pixels corresponding to the detected image signal into a plurality of areas;

calculating a score for each of the plurality of areas based on a portion of the filtered image signal; and setting an area that has a highest score among scores of the plurality of areas as the mura area.

18. The mura compensation method of claim 15, wherein the generating of the first compensation data comprises:

grouping a plurality of pixels corresponding to the detected image signal into a plurality of compensation blocks; and generating the first compensation data corresponding to a first compensation block corresponding to the mura area among the plurality of compensation blocks, wherein each of the plurality of compensation blocks includes a×b number of pixels among the plurality pixels (where each of a and b is a natural number), and wherein a mura corrector generates 2×a number of pieces of the first compensation data for the first compensation block.

* * * * *